US006204599B1

(12) United States Patent
Yamazaki

(10) Patent No.: US 6,204,599 B1
(45) Date of Patent: Mar. 20, 2001

(54) COLOR CATHODE RAY TUBE WITH GRADED SHADOW MASK APERTURES

(75) Inventor: Tatsuya Yamazaki, Fukaya (JP)

(73) Assignee: Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/125,458

(22) PCT Filed: Dec. 25, 1997

(86) PCT No.: PCT/JP97/04811

§ 371 Date: Aug. 19, 1998

§ 102(e) Date: Aug. 19, 1998

(87) PCT Pub. No.: WO98/29891

PCT Pub. Date: Jul. 9, 1998

(30) Foreign Application Priority Data

Dec. 25, 1996 (JP) ..... 8-345194
Dec. 3, 1997 (JP) ..... 9-332949

(51) Int. Cl.[7] ..... H01J 29/07
(52) U.S. Cl. ..... 313/402; 313/403
(58) Field of Search ..... 313/402, 403, 313/407, 408

(56) References Cited

U.S. PATENT DOCUMENTS

| | | | | |
|---|---|---|---|---|
| 3,652,895 | | 3/1972 | Tsuneta et al. | 313/85 S |
| 4,583,022 | | 4/1986 | Masterton | 313/403 |
| 4,631,441 | | 12/1986 | Morrell et al. | 313/408 |
| 4,636,683 | | 1/1987 | Tokita et al. | 313/403 |
| 4,691,138 | | 9/1987 | Masterton | 313/403 |
| 5,243,253 | * | 9/1993 | Marks et al. | 313/402 |
| 5,672,934 | * | 9/1997 | Ohama et al. | 313/402 |

FOREIGN PATENT DOCUMENTS

| | | | |
|---|---|---|---|
| 0 692 810 | 1/1996 | (EP) | H01J/29/07 |
| 2 579 018 | 9/1986 | (FR) | H01J/29/07 |
| 62-100671 | 6/1987 | (JP) | H01J/29/07 |
| 3-192635 | 8/1991 | (JP) | H01J/29/07 |
| 8-083573 | 3/1996 | (JP) | H01J/29/07 |
| 9-082236 | 3/1997 | (JP) | H01J/29/07 |

* cited by examiner

*Primary Examiner*—Michael H. Day
(74) *Attorney, Agent, or Firm*—Pillsbury Winthrop LLP

(57) ABSTRACT

Electron beam passage hole arrays are arrayed on an effective surface of a shadow mask along the Y-axis direction in accordance with a predetermined quartic polynomial. The X-axis direction size of each of electron beam passage holes constituting the electron beam passage hole array is defined on the basis of the quartic polynomial such that the ratio of the hole size to the interval between electron beam passage hole arrays adjacent to each other becomes constant.

8 Claims, 7 Drawing Sheets

| POSITION | RATIO OF SHADOW MASK PITCH TO SLIT SIZE OF PRIOR ART | RATIO OF SHADOW MASK PITCH TO SLIT SIZE OF PRESENT INVENTION | IDEAL RATIO OF SHADOW MASK PITCH TO SLIT SIZE |
|---|---|---|---|
| M1 | 0.251 | 0.251 | 0.251 |
| M2 | 0.248 | 0.251 | 0.251 |
| M3 | 0.236 | 0.249 | 0.249 |

FIG. 10

COLOR CATHODE RAY TUBE WITH GRADED SHADOW MASK APERTURES

This application is the national phase of international application PCT/JP97/04811 filed Dec. 25, 1997 which designated the U.S.

TECHNICAL FIELD

The present invention relates to a color picture tube and, more particularly, to a shadow mask arranged on the inner panel surface of a color picture tube.

BACKGROUND ART

Generally, a color picture tube comprises an envelope constituted by a panel 2 with a substantially rectangular effective portion 1 having a curved inner surface, and a funnel 3 having a funnel shape and joined to the panel 2, as shown in FIG. 3. A phosphor screen 4 having three color phosphor layers which respectively emit blue (B), green (G), and red (R) light beams is formed on the inner surface of the effective portion 1 of the panel 2. In addition, a shadow mask 6 having, on its inner surface, a substantially rectangular and curved effective surface 5 which has a large number of electron beam passage holes for passing electron beams is arranged to oppose the phosphor screen 4.

An electron gun assembly 9 for emitting three electron beams 8B, 8G, and 8R is disposed in a neck 7 of the funnel 3. The three electron beams 8B, 8G, and 8R emitted from the electron gun assembly 9 are deflected by a deflection device 10 mounted on the outer surface of the funnel 3. When the electron beams BB, 8G, and BR pass through the electron beam passage holes of the shadow mask 6 and scan the phosphor screen 4 in the horizontal and vertical directions, a color image is displayed.

Of such color picture tubes, especially, in an in-line color picture tube which emits the three electron beams BB, 8G, and BR arranged in a line on the same horizontal plane, each of the three color phosphor layers of the phosphor screen 4 has a stripe shape elongated in the vertical direction. Accordingly, the shadow mask 6 has electron beam passage hole arrays each having a plurality of electron beam passage holes arrayed in a line along the minor axis direction of the effective surface 5. The plurality of electron beam passage hole arrays are arranged in parallel along the major axis direction of the effective surface 5.

This shadow mask 6 as a color selection electrode originally has a function of landing the three electron beams BB, BG, and BR which have passed through the electron beam passage holes at different angles on the corresponding three color phosphor layers and causing them to emit light. To display an image having a satisfactory color purity on the phosphor screen 4, the three electron beams BB, 8G, and BR which have passed through the electron beam passage holes at different angles must be reliably landed on the corresponding three color phosphor layers.

For this purpose, a predetermined matching relationship must be established between the three color phosphor layers and the electron beam passage holes of the shadow mask 6, and additionally, the matching relationship must be held during the operation of the color picture tube. In other words, the gap between the inner surface of the effective portion 1 of the panel 2, i.e., the phosphor screen 4 and the effective surface 5 of the shadow mask 6, i.e., a so-called q value must always be held within a predetermined allowance.

In the shadow-mask color picture tube, electron beams which pass through the electron beam passage holes of the shadow mask 6 and reach the phosphor screen 4 are 1/3 or less the electron beams emitted from the electron gun assembly 9 because of its operational principle. The remaining electron beams collide with portions other than the electron beam passage holes and are converted into a heat energy to heat the shadow mask 6. As a result, a shadow mask consisting of, e.g., low-carbon steel having a large thermal expansion coefficient expands toward the phosphor screen 4, i.e., causes doming, as indicated by an alternate long and short dashed line in FIG. 4. If doming occurs, the position of an electron beam passage hole 12 changes. When the distance between the phosphor screen 4 and the shadow mask 6 falls outside the allowance, the amount of beam landing shift on a phosphor layer 11 largely changes depending on the luminance and duration of an image pattern to be drawn on the screen. Particularly, when a high-luminance image pattern is locally displayed, local doming occurs, as shown in FIG. 4. The beam landing shifts in a short time, and the landing shift amount increases.

A shadow mask for reducing the landing shift amount is disclosed in Jpn. Pat. Appln. KOKAI Publication No. 08-083573.

For the landing shift due to local doming, an experiment was conducted in which a signal device for generating a rectangular-window-shaped pattern was used to draw a high-luminance pattern 14 having a rectangular window shape on the screen, as shown in FIG. 5, and the beam landing shift amount was measured while changing the shape and position of this high-luminance pattern 14, and the following result was obtained. In this measurement experiment, an elongated high-luminance pattern was drawn with large current beams along the minor axis direction of the screen, i.e., along a vertical axis corresponding to the Y-axis in FIG. 5. This experiment revealed that when the high-luminance pattern was displayed at a position separated, by about 1/3 a width w of the major axis, from the screen center along the major axis, i.e., the horizontal axis corresponding to the X-axis shown in FIG. 5, the beam landing shift was maximized. Especially, the beam landing shift was maximized in an elliptical region 15 at the intermediate portion of the screen shown in FIG. 6. The operational principle has been explained.

In the color picture tube disclosed in Jpn. Pat. Appln. KOKAI Publication No. 08-083573, to minimize the beam landing shift, the interval between electron beam passage hole arrays of the shadow mask 6 is changed depending on the position on the effective surface 5. More specifically, on an orthogonal coordinate system using the center of the effective surface 5 as the origin and the major and minor axes of the effective surface 5 as coordinate axes, an interval PH(N) between an (N−1)th electron beam passage hole array and an Nth electron beam passage hole array from an electron beam passage hole array passing through the central portion of the effective surface 5 toward the periphery of the effective surface 5 along the major axis direction is given by a quartic function of N:

$$PH(N)=A+BN^2+CN^4$$

where A, B, and C are quartic functions of a coordinate value y along the minor axis direction respectively, and C temporarily decreases and then increases along with an increase in the absolute value of the coordinate value y.

In this shadow mask 6, the interval between electron beam passage hole arrays which pass through a portion separated from the center of the effective surface 5 by 1/3 the major-axis-direction width w of the effective surface 5 increases near the major axis as the absolute value of the coordinate value in the minor axis direction of the effective surface 5 increases. The interval is set on the basis of the quartic function of the coordinate value y along the minor axis direction on the orthogonal coordinate system, which has an inflection point within the effective surface 5.

However, even when the interval between the electron beam passage hole arrays adjacent to each other is set on the basis of such a quartic function, and the beam landing shift can be reduced, the ratio of the major-axis-direction size of the electron beam passage hole to the interval between the electron beam passage hole arrays is inappropriate because the hole size is defined in accordance with a relatively simple equation. For this reason, when the color picture tube emits light, the image may be dark near a point P3 shown in FIG. 6 and have a color other than white at a point P4, resulting in a degradation in quality of a white image.

In FIG. 7, the interval between the electron beam passage hole arrays on the effective shadow mask surface is defined on the basis of the above-described quartic function. For this reason, the interval is large at a point M2 and small at a point M3. On the other hand, the major-axis-direction size of the electron beam passage hole is defined by a relatively simple quadratic function or the like at the intermediate portion between the screen center and the end of the effective surface such that the hole has an appropriate size at the screen center and at the end of the effective surface. The major-axis-direction size of the electron beam passage hole may be smaller at the point M2 or larger at the point M3 than the appropriate size.

More specifically, at the point M2 where the interval between the electron beam passage hole arrays is relatively large, the major-axis-direction size of the electron beam passage hole becomes small. At the point M3 where the interval between the electron beam passage hole arrays is relatively small, the major-axis-direction size of the electron beam passage hole becomes large. For this reason, the image is dark at the point M2 and bright at the point M3, resulting in luminance irregularity.

Assume that, over the effective surface of the shadow mask 6, the major-axis-direction size of the electron beam passage hole is set in accordance with a simple quadratic or quartic function at four points O, M4, M5, and M6 in FIG. 7. In FIG. 8, the major-axis-direction sizes of electron beam passage holes from the point M1 on the major axis, which is separated from the center of the effective surface of the shadow mask 6 by about 1/3 a major-axis-direction width w' of the effective surface, to the point M2 separated along the minor axis direction by 1/4 a width H of the minor axis is indicated by a grade curve.

When the grade curve of major-axis-direction sizes of electron beam passage holes is represented by a quadratic curve 50 or quartic curve 51, an error from an ideal grade curve 52 is generated at the point M2. When this error is too large or too small with respect to the ideal grade curve 52, the color purity of a white image degrades.

DISCLOSURE OF INVENTION

The present invention has been made to solve the above problem, and has as its object to provide a color picture tube which can display a satisfactory white image by appropriately setting the ratio of the major-axis-direction size of an electron beam passage hole of a shadow mask and the interval between electron beam passage hole arrays.

According to the present invention, there is provided a color picture tube comprising:

an electron gun assembly for emitting a plurality of electron beams;

a shadow mask having a substantially rectangular effective surface on which electron beam passage holes for passing the plurality of electron beams emitted from the electron gun assembly are formed, and a plurality of electron beam passage hole arrays each formed by arraying the plurality of electron beam passage holes along a minor axis direction parallel to a short side of the effective surface are arranged in parallel along a major axis direction parallel to a long side of the effective surface; and a phosphor screen for emitting light upon landing the electron beams which have passed through the electron beam passage holes of the shadow mask, wherein on an orthogonal coordinate system using a center of the effective surface of the shadow mask as an origin and a major axis passing through the origin and a minor axis passing through the origin as coordinate axes, a major-axis-direction size of each of the electron beam passage holes formed in the shadow mask is defined on the basis of a function of the orthogonal coordinate system such that the size changes depending on a position on the effective surface, and on the minor axis, the hole size temporarily decreases and then increases from the origin toward the long side of the effective surface, temporarily increases and then decreases from a point on the major axis, which is separated from the origin by 1/3 a length of the major axis, toward the long side along the minor axis direction, and, on the short side of the effective surface, temporarily decreases and then increases from an end of the major axis toward a corner of the effective surface.

According to the present invention, there is also provided a color picture tube comprising:

an electron gun assembly for emitting a plurality of electron beams;

a shadow mask having a substantially rectangular effective surface on which electron beam passage holes for passing the plurality of electron beams emitted from the electron gun assembly are formed, and a plurality of electron beam passage hole arrays each formed by arraying the plurality of electron beam passage holes along a minor axis direction parallel to a short side of the effective surface are arranged in parallel along a major axis direction parallel to a long side of the effective surface; and a phosphor screen for emitting light upon landing the electron beams which have passed through the electron beam passage holes of the shadow mask, wherein on an orthogonal coordinate system using a center of the effective surface of the shadow mask as an origin and a major axis passing through the origin and a minor axis passing through the origin as coordinate axes, a major-axis-direction size of each of the electron beam passage holes formed in the shadow mask is defined on the basis of a function of the orthogonal coordinate system such that the size changes depending on a position on the effective surface, and on the minor axis, the hole size is substantially constant from the origin to an intermediate portion between the major axis and the long side toward the long side of the effective surface and decreases from the intermediate portion, is substantially constant from a point on the major axis, which is separated from the origin by 1/3 a length of the major axis, to the intermediate portion between the major axis and the long side and increases from the intermediate portion, and on the short side of the effective surface, increases from an end of the major axis toward a corner of the effective surface.

According to the color picture tube of the present invention, the ratio of the major-axis-direction size of each of electron beam passage holes constituting the electron beam passage hole array to the interval between electron beam passage hole arrays can be set at an appropriate value. For example, at the points M2, M3, and M4 shown in FIG. 7, the ratio of the size of the electron beam passage hole to the interval between electron beam passage hole arrays can be set at an appropriate value.

For this reason, the color picture tube can display a satisfactory white image by suppressing the luminance irregularity.

BRIEF DESCRIPTION OF DRAWINGS

FIG. 10 is a table showing the ratios of the interval (shadow mask pitch) between electron beam passage hole arrays adjacent to each other to the major-axis-direction size (slit size) of the electron beam passage hole from the point M1 to a point M3 in FIG. 7;

BEST MODE OF CARRYING OUT THE INVENTION

A color picture tube according to an embodiment of the present invention will be described below in detail with reference to the accompanying drawing.

Figure 2:
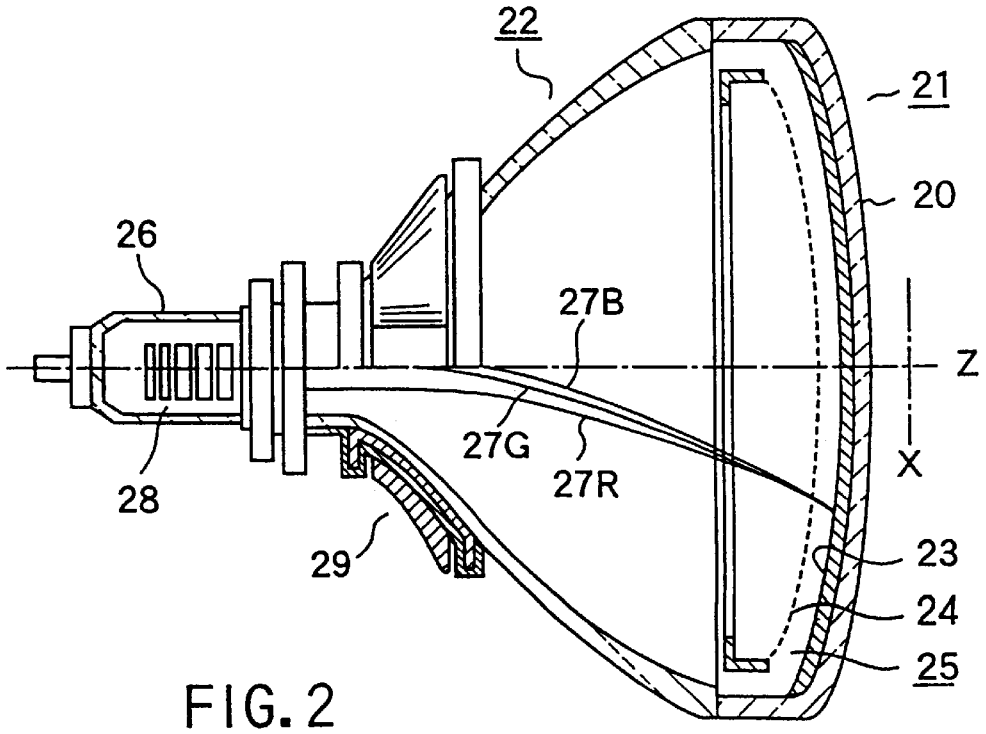
FIG. 2 is a partially sectional view schematically showing the arrangement of the color picture tube according to the embodiment of the present invention.
Figure 3:
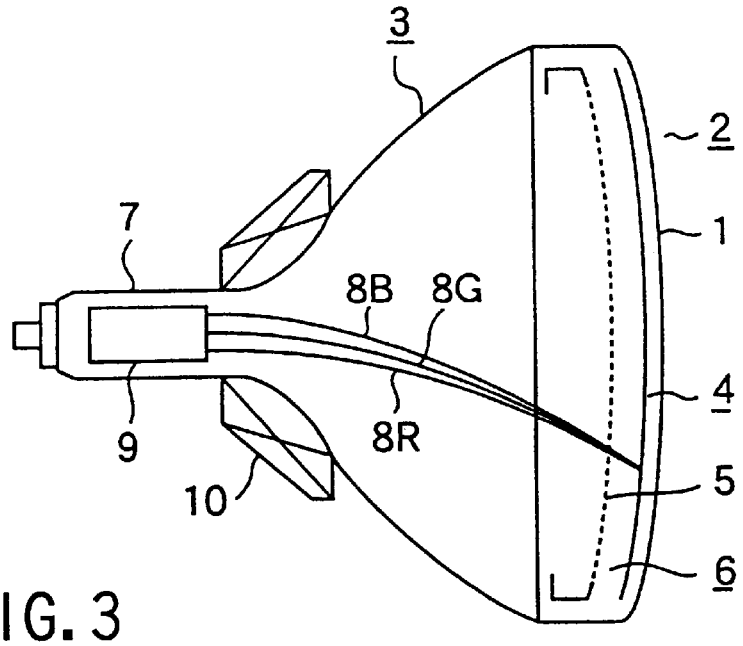
FIG. 3 (PRIOR ART)
FIG. 3 is a sectional view schematically showing the arrangement of a conventional color picture tube.
Figure 4:
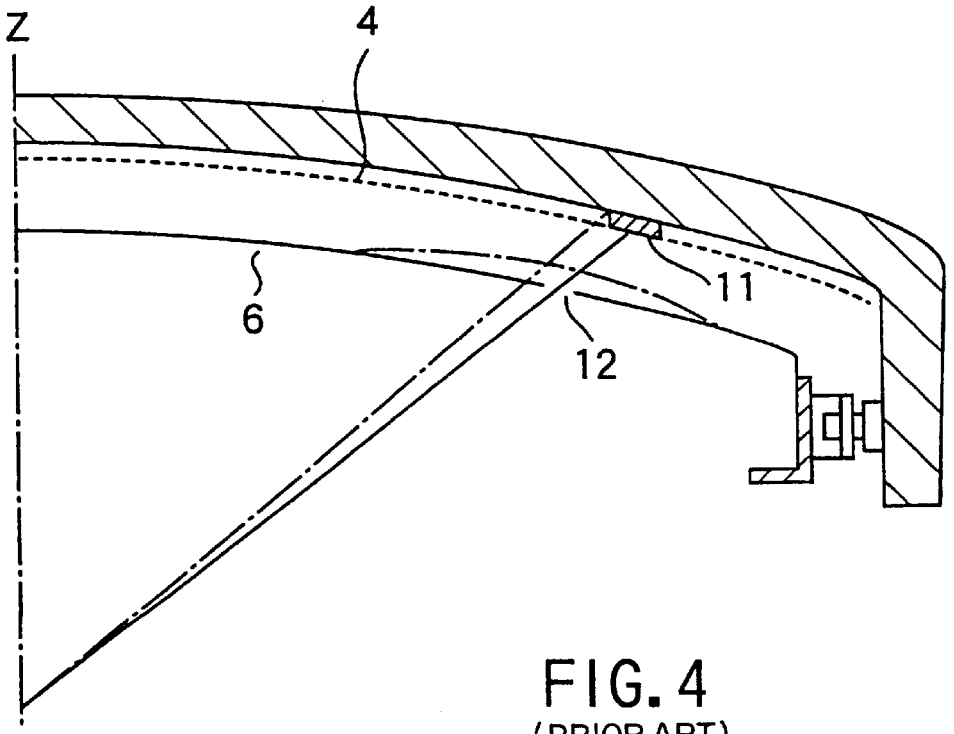
FIG. 4 (PRIOR ART)
FIG. 4 is a view for explaining a beam landing shift due to doming on a shadow mask.
Figure 5:
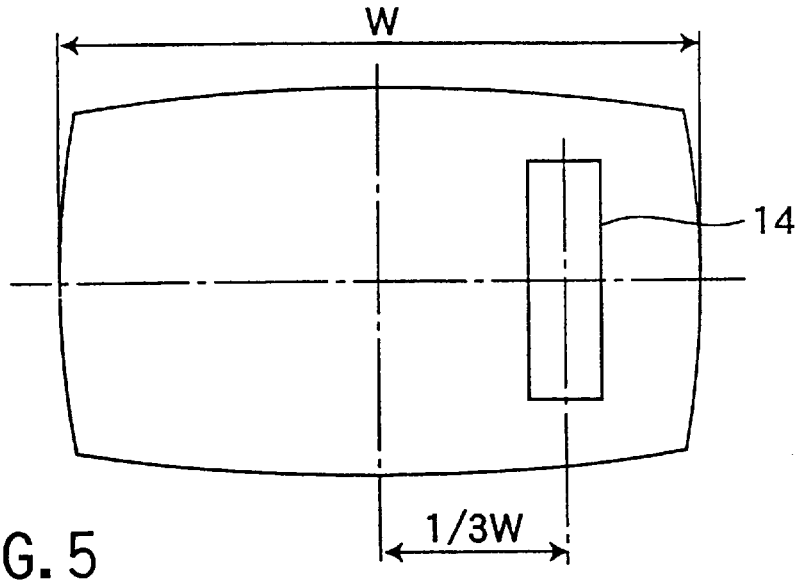
FIG. 5 (PRIOR ART)
FIG. 5 is view for explaining the generation situation of local doming on the shadow mask.
Figure 6:
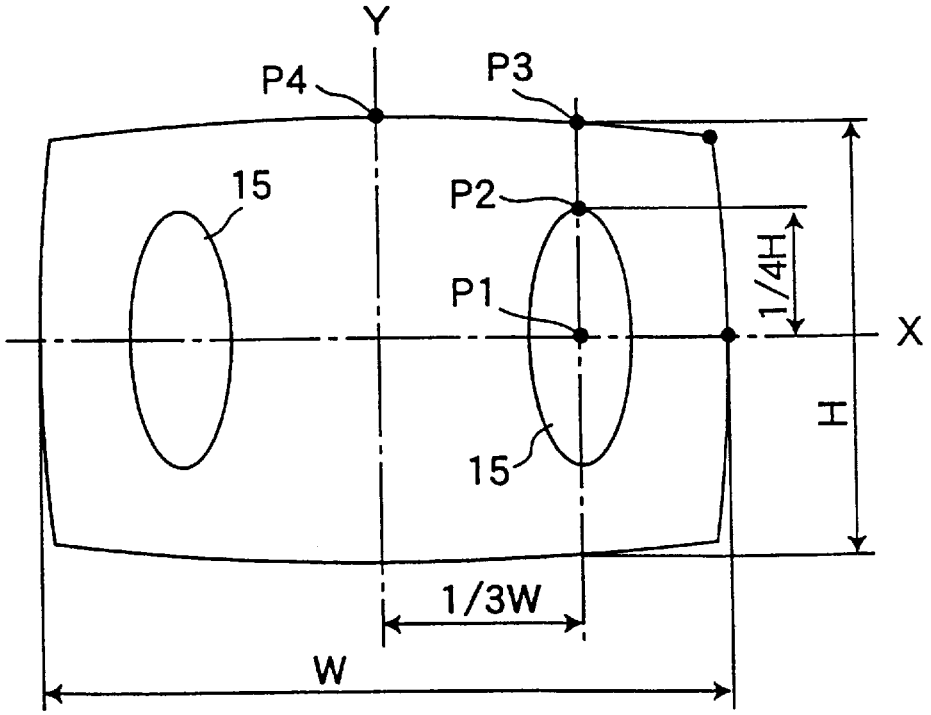
FIG. 6 (PRIOR ART)
FIG. 6 is a view showing a region where a beam landing shift is generated due to local doming on the shadow mask.

FIG. 2 is a partially sectional view of a color picture tube according to an embodiment of the present invention, which is taken along the horizontal direction, i.e., the X-axis direction.

This color picture tube has an envelope constituted by a panel 21 with a substantially rectangular effective portion 20 having a curved inner surface, and a funnel 22 having a funnel shape and joined to the panel 21. A phosphor screen 23 having three color phosphor layers which respectively emit blue (B), green (G), and red (R) light beams is formed on the inner surface of the effective portion 20 of the panel 21. Each of the three color phosphor layers has a stripe shape elongated along the minor axis direction of the effective portion 20, i.e., in the vertical direction. In addition, a shadow mask 25 having, on its inner surface, a substantially rectangular and curved effective surface 24 with a large number of electron beam passage holes for passing electron beams, which are arrayed as will be described later, is arranged to oppose the phosphor screen 23.

An electron gun assembly 28 for emitting three electron beams 27B, 27G, and 27R arranged in a line in the horizontal direction, i.e., the X-axis direction is disposed in a neck 26 of the funnel 22. The three electron beams 27B, 27G, and 27R are deflected by a magnetic field generated by a deflection device 29 mounted on the outer surface of the funnel 22. When the electron beams 27B, 27G, and 27R pass through the electron beam passage holes of the shadow mask 25 and scan the phosphor screen 23 in the horizontal and vertical directions, a color image is displayed.

Figure 1:
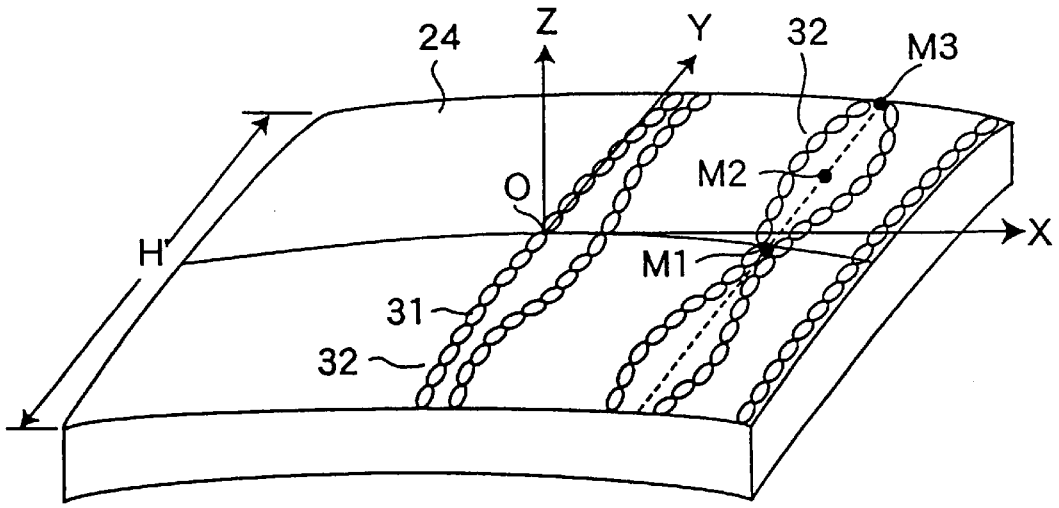
FIG. 1 is a perspective view showing the arrangement of a shadow mask used for a color picture tube according to an embodiment of the present invention.

As shown in FIG. 1, the electron beam passage holes of the shadow mask 25 constitute an electron beam passage hole array 32 in which a plurality of electron beam passage holes 31 are arrayed along the minor axis direction of the effective surface 24, i.e., along the vertical axis corresponding to the Y-axis shown in FIG. 1. A plurality of electron beam passage hole arrays 32 are arranged in parallel along the major axis direction, i.e., along the horizontal axis corresponding to the X-axis in FIG. 1.

More specifically, an orthogonal coordinate system is defined using a center O of the effective surface 24 of the shadow mask 25 as its origin and the major and minor axes of the effective surface as coordinate axes. On this orthogonal coordinate system, an interval PH(N) between an (N−1) th electron beam passage hole array 32 and an Nth electron beam passage hole array 32 from the electron beam passage hole array 32 passing through the center O of the effective surface 24 of the shadow mask 25, i.e., the origin toward the periphery along the major axis direction is given by a quartic function of N:

$$PH(N)=A+BN^2+CN^4$$

where A, B, and C are quartic functions of a coordinate value y along the minor axis direction respectively, and C temporarily decreases and then increases as the absolute value of the coordinate value y increases. The plurality of electron beam passage hole arrays 32 extending along the minor axis are arranged in the major axis direction. The coefficients A and B of this equation are changed in accordance with the coefficient C such that the effective surface 24 has a substantially rectangular shape.

When the interval between the electron beam passage hole arrays 32 on the shadow mask 25 is set on the basis of this equation, a change in position of the electron beam passage hole due to local doming on the shadow mask 25 can be prevented, so the beam landing shift can be prevented.

On the coordinate system using the center O of the effective surface 24 of the shadow mask 25 as the origin and the major and minor axes as coordinate axes, the size of the electron beam passage hole 31 in a direction parallel to the major axis of the effective surface 24, i.e., the hole size is set as follows. A major-axis-direction size D(N) of the electron beam passage hole 31 of the Nth electron beam passage hole array 32 from the electron beam passage hole array 32 passing through the center O of the shadow mask 25, i.e., the origin is given by a quartic function of N:

$$D(N)=a+bN^2+cN^4$$

where a, b, and c are quartic functions of a coordinate value y along the minor axis direction respectively.

Alternatively, on the coordinate system using the center O of the effective surface 24 of the shadow mask as the origin and the major and minor axes as coordinate axes, the size of the electron beam passage hole 31 in a direction parallel to the major axis of the effective surface 24, i.e., the hole size is set as follows. A major-axis-direction size D(x, y) of the electron beam passage hole 31 of the Nth electron beam passage hole array 32 from the electron beam passage hole array 32 passing through the center O of the shadow mask 25, i.e., the origin is given by a quartic function of the coordinate value x along the major axis direction and the coordinate value y along the minor axis direction:

$$D(x, y)=a_0+a_1x^2+a_2x^4+a_3y^2+a_4x^2y^2+a_5x^4y^2+a_6y^4+a_7x^2y^4+a_8x^4y^4$$

where $a_0$ to $a_8$ are coefficients.

The major-axis-direction size of the electron beam passage hole 31 of the shadow mask 25 is set on the basis of this equation. The electron beam passage hole array 32 having an interval given by:

$$PH(N)=A+BN^2+CN^4$$

can appropriately set the major-axis-direction size of each of the electron beam passage holes 31 constituting this line at a corresponding position.

That is, the electron beam passage hole arrays 32 are not arranged in parallel along the minor axis direction. Instead, the interval PH(N) between the electron beam passage hole arrays 32 adjacent to each other is defined on the basis of the quartic function of N. For this reason, the interval between the electron beam passage hole arrays 32 may be small (high density) or large (low density) depending on the position along the minor axis direction of the effective surface 24. When the major-axis-direction size of the electron beam passage hole 31 is made substantially constant or is defined according to a relatively simple quadratic function independently of the interval between the electron beam passage hole arrays 32, the screen may be bright at a portion where the interval between the electron beam passage hole arrays 32 is small or dark at a portion where the interval between the electron beam passage hole arrays 32 is large, resulting in luminance irregularity. This phenomenon is conspicuous in a display of a white image.

To prevent this, the major-axis-direction size of the electron beam passage hole 31 is defined on the basis of the interval between the electron beam passage hole arrays 32, as in this embodiment. More specifically, the major-axis-direction size is made relatively small where the electron beam passage hole arrays 32 are arranged at a high density or relatively large where the electron beam passage hole arrays 32 are arranged at a low density. This means that the ratio of the major-axis-direction size of the electron beam passage hole 31 to the interval between the electron beam passage hole arrays 32 is substantially constant independently of the position on the effective surface.

With this arrangement, when an image and, more particularly, a white image is displayed on the phosphor screen, the luminance variation on the screen can be suppressed, so a color image having a satisfactory color purity can be displayed.

Figure 7:
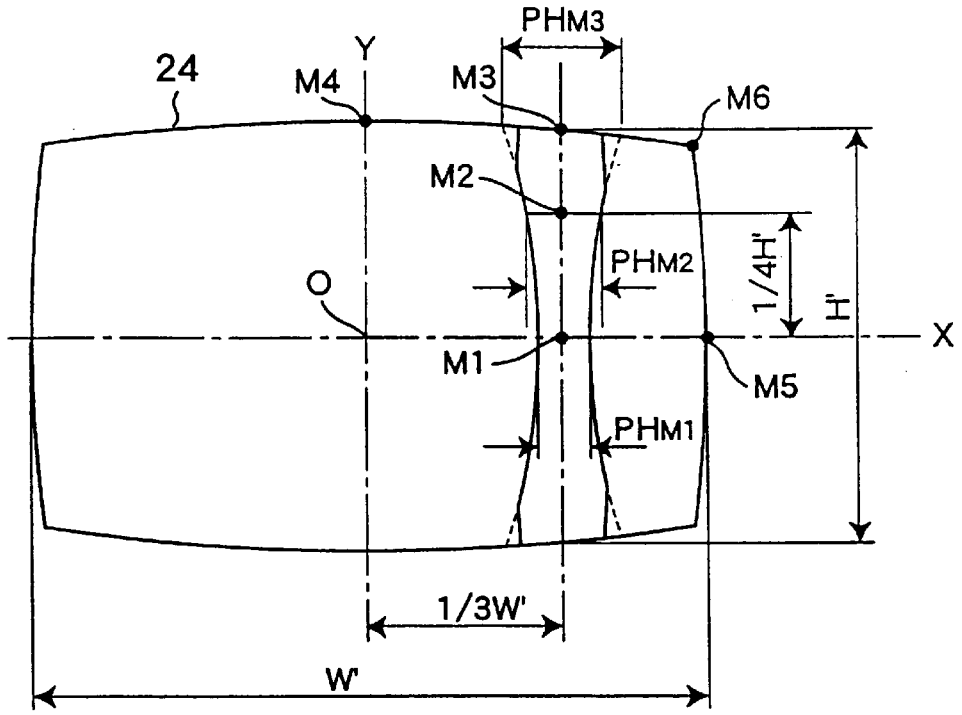
FIG. 7 (PRIOR ART)
FIG. 7 is a view for explaining a problem of the shadow mask on which the interval between electron beam passage hole arrays on the shadow mask changes on the basis of a quadratic function of the minor-axis-direction distance from the major axis.
Figure 8:
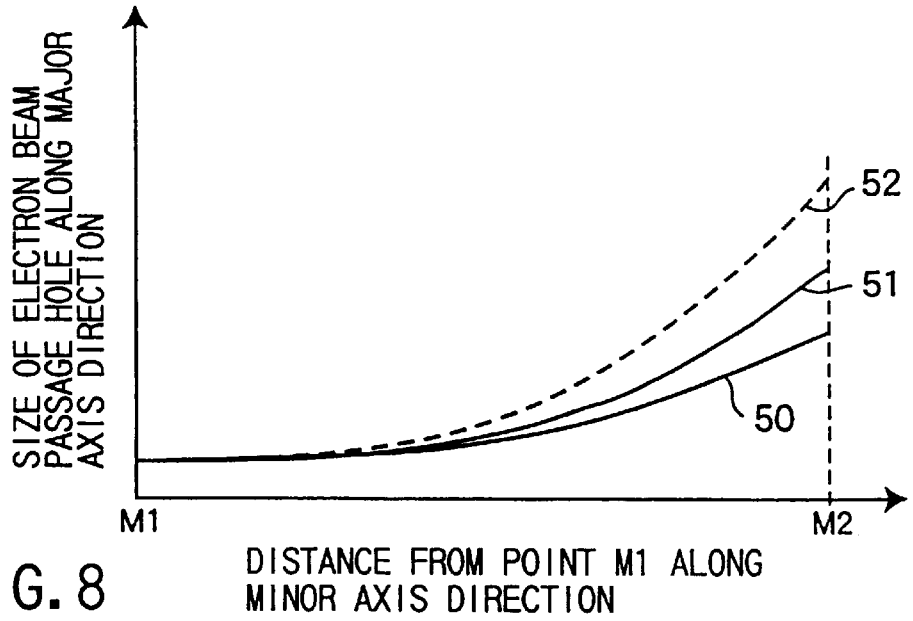
FIG. 8 is a graph showing the relationship between the minor-axis-direction distance and the major-axis-direction size of the electron beam passage hole from a point M1 to a point M2 shown in FIG. 7.

When the major-axis-direction size of the electron beam passage hole 31 is set on the basis of the above-described equation:

$$D(N)=a+bN^2+cN^4$$

or $$D(x, y)=a_0+a_1x^2+a_2x^4+a_3y^2+a_4x^2y^2+a_5x^4y^2+a_6y^4+a_7x^2y^4+a_8x^4y^4$$

the major-axis-direction size D(N) or D(x, y) of the electron beam passage hole 31 from a point M1 on the major axis (X-axis), which is separated from the center O of the effective surface 24 of the shadow mask by about 1/3 the width w' of the major axis of the effective surface, to a point M2 separated from the point M1 by about 1/4 a width H' of the short side along the minor axis (Y-axis), as shown in FIG. 7, changes to substantially match an ideal grade curve 52 shown in FIG. 8.

Figure 9:
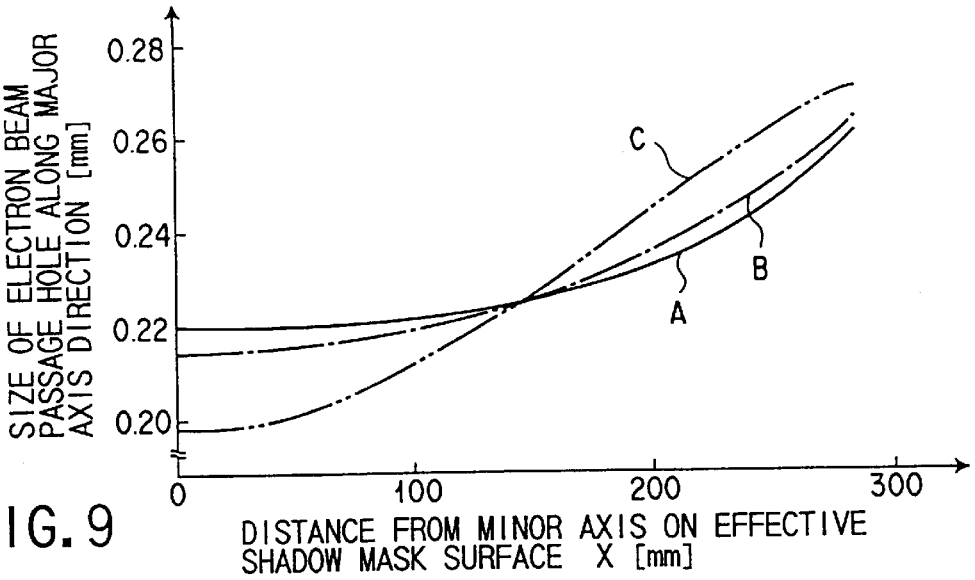
FIG. 9 is a graph showing the relationship between the major-axis-direction distance from the minor axis and the major-axis-direction size of the electron beam passage hole.

Similarly, when the major-axis-direction size of the electron beam passage hole 31 is set on the basis of the above-described equation, the major-axis-direction size of the electron beam passage hole 31 changes in correspondence with a grade curve shown in FIG. 9 as the position of the electron beam passage hole moves from the minor axis, i.e., the Y-axis shown in FIG. 7 toward the major axis, i.e., the X-axis.

A grade curve A indicated by a solid line in FIG. 9 shows a change in the major-axis-direction size of the electron beam passage hole 31 on the major axis, i.e., the X-axis. A grade curve B indicated by an alternate long and short dashed line shows a change in the major-axis-direction size of the electron beam passage hole 31 on a line along the X-axis from the intermediate point between the center O of the effective surface and an end portion M4 of the Y-axis. A grade curve C indicated by an alternate long and two short dashed line shows a change in the major-axis-direction size of the electron beam passage hole 31 on a line along the X-axis from the end portion M4 of the Y-axis to a diagonal point M6.

When the major-axis-direction size of the electron beam passage hole 31 is appropriately set at an arbitrary position on the effective surface, the ratio of the major-axis-direction size of the electron beam passage hole 31 to the interval between the electron beam passage hole arrays 32 can be made substantially constant.

A case in which the present invention is applied to a color picture tube whose phosphor screen has a diagonal length of 34 inches will be described next.

Assume that the major-axis-direction size D(x, y) of the electron beam passage hole 31 is defined on the basis of the equation:

$$D(x, y)=a_0+a_1x^2+a_2x^4+a_3y^2+a_4x^2y^2+a_5x^4y^2+a_6y^4+a_7x^2y^4+a_8x^4y^4$$

Of the coefficients $a_0$ to $a_8$, $a_0$ corresponds to the major-axis-direction size of the electron beam passage hole 31 at the center of the effective shadow mask surface, i.e., the origin O.

Figure 12:
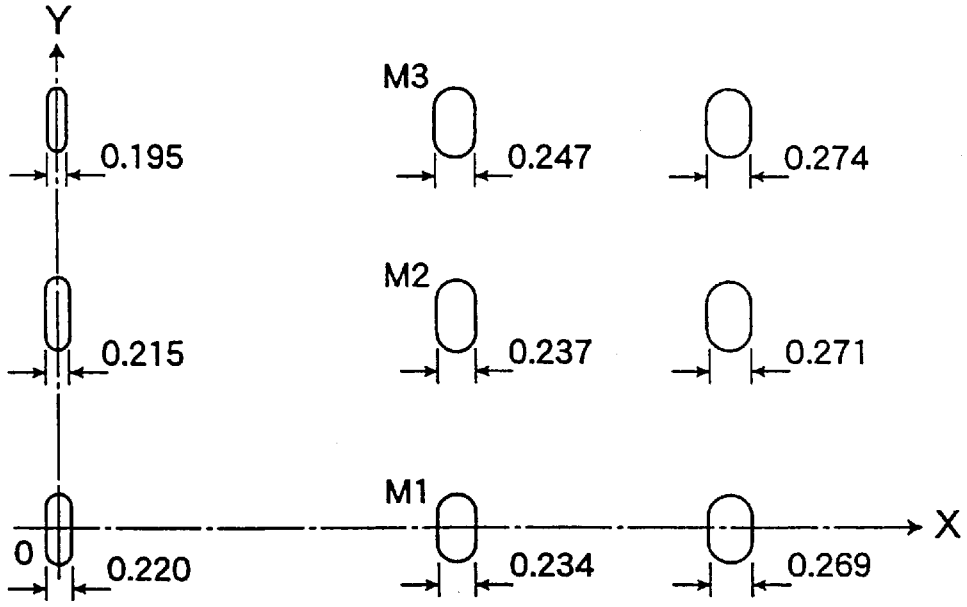
FIG. 12 is a view showing a distribution example of the major-axis-direction sizes of electron beam passage holes in a quadrant on the effective shadow mask surface of a 34-inch color picture tube to which the present invention is applied.

FIG. 12 is a view showing a distribution example of the major-axis-direction sizes of the electron beam passage holes 31 in a quadrant of the effective shadow mask surface of the 34-inch color picture tube to which the present invention is applied.

As shown in FIG. 12, on the Y-axis, the hole size is 0.220 mm at the origin O, 0.215 mm at the intermediate point between the origin O and the end of the Y-axis, and 0.195 mm at the end of the Y-axis. On the minor axis of the effective surface, the size hole is substantially constant from the origin O to the intermediate point and gradually decreases from the intermediate point toward the end of the Y-axis. In this example, the hole size decreases at a very low rate in the section where the hole size is substantially constant.

At the point M1, the hole size is 0.234 mm; at the point M2, 0.237 mm; and at the point M3, 0.247 mm. The hole size is substantially constant along the Y-axis from the point M1 on the X-axis, which is separated from the origin O of the effective surface by 1/3 the length of the major axis, to the intermediate point between the X-axis and the long side, and gradually increases from the intermediate point to the point M3 on the long side. In this example, the hole size increases at a very low rate in the section where the hole size is substantially constant.

On the short side of the effective surface, the hole size is 0.269 mm at the end of the X-axis; 0.271 mm at the intermediate point between the end of the X-axis and the corner of the effective surface, i.e., the diagonal end; and 0.274 mm at the diagonal end. On the short side of the effective surface, the hole size is gradually increases from the end of the x-axis to the diagonal end. In this example, the hole size increases at a very low rate in the section where the hole size is substantially constant.

FIG. 10 is a table showing the ratios of the major-axis-direction size of the electron beam passage hole 31 to the interval between the electron beam passage hole arrays 32 adjacent to each other, i.e., the shadow mask pitch from the point M1 on the major axis, which is separated from the center of the effective surface 24 of the shadow mask by about 1/3 the width w' of the major axis of the effective surface, to the point M3 separated along the minor axis by about 1/2 the width H' of the short side, as shown in FIG. 7.

In this table, the ratios of the slit size to the shadow mask pitches at the points M1, M2, and M3 are compared for each of a case wherein the slit size is defined on the basis of the conventionally applied equation, a case wherein the equation described in this embodiment is applied, and an ideal case.

Figure 11:
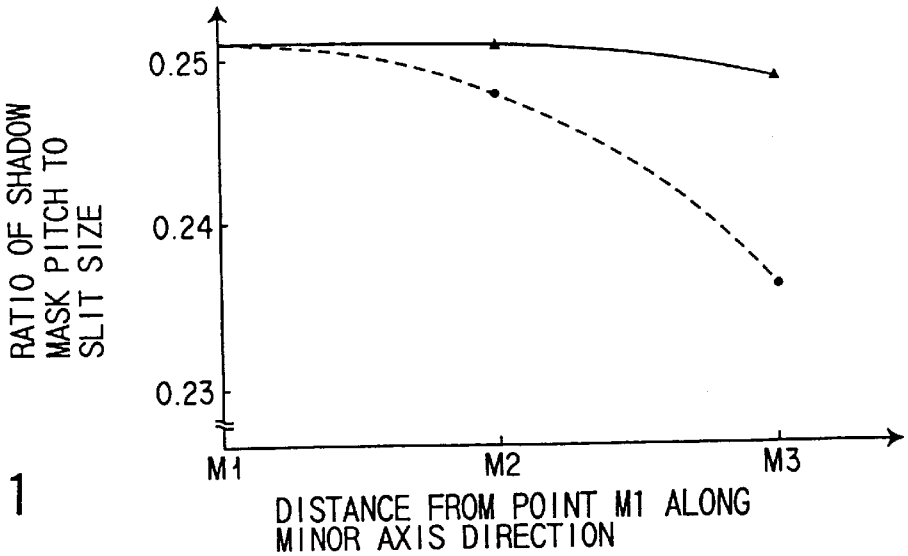
FIG. 11 is a graph showing the relationship between the minor-axis-direction distance and the ratio of the slit size to the shadow mask pitch shown in FIG. 10 from the point M1 to the point M3.

FIG. 11 is a graph showing the relationships shown in FIG. 10.

The solid line in FIG. 11 indicates the ratio of the slit size to the shadow mask pitch in the ideal case and in the case wherein the slit size is defined by applying:

$$D(x, y)=a_0+a_1x^2+a_2x^4+a_3y^2+a_4x^2y^2+a_5x^4y^2+a_6y^4+a_7x^2y^4+a_8x^4y^4$$

The dotted line in FIG. 11 indicates the ratio of the slit size to the shadow mask pitch in case wherein the slit size is defined on the basis of the conventionally applied equation.

As is apparent from FIGS. 10 and 11, the case wherein the equation described in the embodiment of the present invention is used matches the ideal case. However, the case wherein the conventional equation is used deviates from the ideal case. Particularly, a large difference is generated at the point M3.

As described above, when the slit size is defined in accordance with the above-described equation:

$$D(x, y)=a_0+a_0x^2+a_2x^4+a_3y^2+a_4x^2y^2+a_5x^4y^2+a_6y^4+a_7x^2y^4+a_8x^4y^4$$

the ratio of the slit size to the shadow mask pitch can be made to substantially match the ideal value, and this ratio can be kept substantially constant.

In this case, the ratios of the slit size to the shadow mask pitches at the points M1, M2, and M3 have been compared. However, at another arbitrary position, this ratio can be made substantially constant.

Therefore, the ratio of the major-axis-direction hole size to the interval between the electron beam passage hole arrays 32 can be made substantially constant independently of the position on the effective surface. With this arrangement, when an image and, more particularly, a white image is displayed on the phosphor screen, the luminance variation on the screen can be suppressed, so a color image having a satisfactory color purity can be displayed.

Even when the major-axis-direction size of the electron beam passage hole is set in accordance with the other equation which has been described in this embodiment:

$$D(N)=a+bN^2+cN^4$$

the same result as described above can be obtained, as a matter of course.

Figure 13:
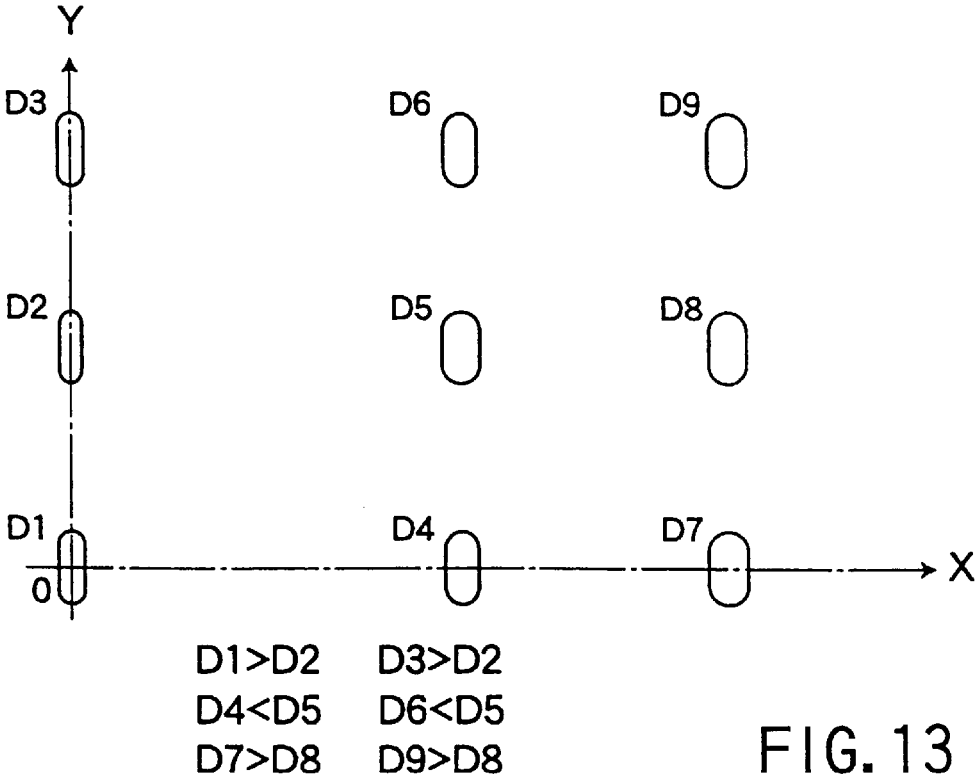
FIG. 13 is a view showing another distribution example of the major-axis-direction sizes of electron beam passage holes in the quadrant on the effective shadow mask surface of the 34-inch color picture tube to which the present invention is applied.

FIG. 13 is a view showing another distribution example of the major-axis-direction sizes of the electron beam passage holes 31 in the quadrant of the effective shadow mask surface.

As shown in FIG. 13, on the Y-axis, let D1 be the hole size at the origin O, D2 be the hole size at the intermediate point between the origin O and the end of the Y-axis, and D3 be the hole size at the end of the Y-axis. On the minor axis of the effective surface, the hole size gradually decreases from the origin O to the intermediate point and gradually increases from the intermediate point toward the end of the Y-axis.

Let D4 be the hole size at the point M1, D5 be the hole size at the point M2, and D6 be the hole size at the point M3. The hole size gradually increases from the point M1 on the X-axis of the effective surface, which is separated from the origin O by 1/3 the length of the major axis, to near the intermediate point between the X-axis and the long side in a direction parallel to the Y-axis and gradually decreases from the intermediate point toward the point M3 on the long side.

On the short side of the effective surface, let D7 be the hole size at the end of the X-axis, DB be the hole size at the intermediate point between the end of the X-axis and the corner of the effective surface, i.e., the diagonal end, and D9 be the hole size at the diagonal end. On the short side of the effective surface, the hole size gradually decreases from the end of the X-axis to the intermediate point and gradually increases from the intermediate point toward the diagonal end.

That is, the function D(x, y) which defines the hole size has an inflection point near the intermediate point.

Even when the major-axis-direction hole sizes of the electron beam passage holes are distributed as shown in FIG. 13, the same effect as described above can be obtained.

As described above, even when the array of the electron beam passage hole arrays on the shadow mask is set on the basis of the quartic polynomial, the electron beam passage hole 31 can have an appropriate major-axis-direction size at an arbitrary position, and the ratio of the major-axis-direction hole size to the interval between the electron beam passage hole arrays 32 can be made substantially constant. For this reason, a color picture tube capable of displaying a white image without degrading the color purity can be constituted.

Industrial Applicability

As has been described above, according to the present invention, by optimizing the ratio of the major-axis-direction size of the electron beam passage hole of the shadow mask to the interval between the electron beam passage hole arrays, a color picture tube capable of displaying a satisfactory white image can be provided.

What is claimed is:

1. A color picture tube comprising:

an electron gun assembly for emitting a plurality of electron beams;

a shadow mask having a substantially rectangular effective surface on which electron beam passage holes for passing the plurality of electron beams emitted from said electron gun assembly are formed, and a plurality of electron beam passage hole arrays each formed by arraying the plurality of electron beam passage holes along a minor axis direction parallel to a short side of said effective surface are arranged in parallel along a major axis direction parallel to a long side of said effective surface; and a phosphor screen for emitting light upon landing the electron beams which have passed through the electron beam passage holes of said shadow mask, wherein on an orthogonal coordinate system using a center of said effective surface of said shadow mask as an origin and a major axis passing through the origin and a minor axis passing through the origin as coordinate axes, a major-axis-direction size of each of the electron beam passage holes formed in said shadow mask is defined on the basis of a function such that the size changes depending on said effective surface, and on the minor axis, the hole size decreases and then increases from the origin toward said long side of said effective surface, increases and then decreases from a point on the major axis, which is separated from the origin by 1/3 a length of said major axis, toward said long side along the minor axis direction, and, on said short side of said effective surface, decreases and then increases from an end of the major axis toward a corner of said effective surface.

2. A color picture tube comprising:

an electron gun assembly for emitting a plurality of electron beams;

a shadow mask having a substantially rectangular effective surface on which electron beam passage holes for passing the plurality of electron beams emitted from said electron gun assembly are formed, and a plurality of electron beam passage hole arrays each formed by arraying the plurality of electron beam passage holes along a minor axis direction parallel to a short side of said effective surface are arranged in parallel along a major axis direction parallel to a long side of said effective surface; and a phosphor screen for emitting light upon landing the electron beams which have passed through the electron beam passage holes of said shadow mask, wherein on an orthogonal coordinate system using a center of said effective surface of said shadow mask as an origin and a major axis passing through the origin and a minor axis passing through the origin as coordinate axis, a major-axis-direction size of each of the electron beam passage holes formed in said shadow mask is defined on the basis of a function such that the size changes depending on said effective surface, and on the minor axis, the hole size is substantially constant from the origin to an intermediate portion between the major axis and said long side toward said long side of said effective surface and decreases from the intermediate portion toward said long side along the minor axis direction, is substantially constant from a point on the major axis, which is separated from the origin by 1/3 a length of said major axis and said long side and increases from the intermediate portion toward said long side along the minor axis direction, and on said short side of said effective surface, increases from an end of the major axis toward a corner of said effective surface.

3. A tube according to claim 1 or 2, wherein the function for defining the major-axis-direction size of the electron beam passage hole formed in said shadow mask is given by a quartic equation or an equation of higher order.

4. A tube according to claim 3, wherein the function for defining the major-axis-direction size of the electron beam passage hole formed in said shadow mask has an inflection point near the intermediate portion between the major axis and said long side on said effective surface.

5. A tube according to claim 3, wherein letting D(N) be the major-axis-direction size of the electron beam passage hole of an Nth electron beam passage hole array from said electron beam passage hole array passing through the origin, the function for defining the major-axis-direction size of the electron beam passage hole formed in said shadow mask is given by the quartic function of N:

$$D(N)=a+bN^2+cN^4$$

where a, b, and c are quartic functions of a coordinate value along the minor axis direction respectively, on the orthogonal coordinate system using the minor and major axes as coordinate axes.

6. A tube according to claim 3, wherein letting D(x, y) be the major-axis-direction size of the electron beam passage hole of an nth electron beam passage hole array from said electron beam passage hole array passing through the origin, the function for defining the major-axis-direction size of the electron beam passage hole formed in said shadow mask is given by:

$$D(x, y)=a_0+a_1x^2+a_2x^4+a_3y^2+a_4x^2y^2+a_5x^4y^2+a_6y^4+a_7x^2y^4+a_8x^4y^4$$

where x is a coordinate value of the minor axis, y is a coordinate value of the major axis, and $a_0$ to $a_8$ are coefficients.

7. A tube according to claim 1 or 2, wherein, on said effective surface of said shadow mask, the major-axis-direction size of the electron beam passage hole is defined such that a ratio of the major-axis-direction size of the electron beam passage hole to an interval between electron beam passage hole arrays adjacent to each other is substantially constant at an arbitrary position on said effective surface.

8. A tube according to claim 1 or 2, wherein said electron beam passage holes are arranged having a distance PH(N) between an (N−1)th array and an $N^{th}$ array, counted from an array passing a center O of the effective surface, said PH(N) is given as:

$$PH(N)=A+BN^2+CN^4$$

where A, B and C are fourth degree functions of a Y-coordinate in a coordinate system having said origin O, and C is a function which first decreases and then increases as the absolute value of the Y-coordinate increases.

* * * * *